US006101463A

United States Patent [19]

Lee et al.

[11] Patent Number: 6,101,463

[45] Date of Patent: Aug. 8, 2000

[54] METHOD FOR COMPRESSING A SPEECH SIGNAL BY USING SIMILARITY OF THE $F_1/F_0$ RATIOS IN PITCH INTERVALS WITHIN A FRAME

[75] Inventors: Sang Hyo Lee, Kyonggi-Do; Myung Jin Bac, Seoul; Hyubg Goue Chung, Seoul; Young Ho Park, Kyonggi-Do; Jae Chan Yang, Seoul, all of Rep. of Korea

[73] Assignee: Seoul Mobile Telecom, Rep. of Korea

[21] Appl. No.: 09/169,164

[22] Filed: Oct. 8, 1998

[30] Foreign Application Priority Data

Dec. 12, 1997 [KR] Rep. of Korea ..... 97-68012

[51] Int. Cl.[7] ..... G10L 19/02

[52] U.S. Cl. ..... 704/207; 704/208

[58] Field of Search ..... 704/206, 207, 704/208, 209

[56] References Cited

U.S. PATENT DOCUMENTS

Re. 32,124 4/1986 Atal ..... 704/230

4,802,221 1/1989 Jibbe ..... 704/208

5,020,058 5/1991 Holden et al. ..... 370/474

*Primary Examiner*—David R. Hudspeth

*Assistant Examiner*—Tālivaldis Ivars Šmits

*Attorney, Agent, or Firm*—Marc J. Luddy

[57] ABSTRACT

A method for compressing a speech signal by using similarity of the $F_1/F_0$ ratios in pitch intervals within a frame. This method comprises the steps of: dividing the speech signal into frames, each being of a predetermined size; checking whether each of the divided frames corresponds to a voiced speech; obtaining an $F_1/F_0$ ratio of an initial pitch interval and of subsequent pitch intervals of each frame corresponding to voiced speech; determining if data in each of the subsequent pitch intervals can be regarded as identical to data in the initial pitch interval by calculating if the difference between the obtained $F_1/F_0$ ratio corresponding to the subsequent pitch interval and the obtained $F_1/F_0$ ratio of the initial pitch interval is smaller than a predetermined value; and compressing data in each of the subsequent pitch intervals if it can be regarded as identical to data in the initial pitch interval according the determining step above.

4 Claims, 3 Drawing Sheets

METHOD FOR COMPRESSING A SPEECH SIGNAL BY USING SIMILARITY OF THE $F_1/F_0$ RATIOS IN PITCH INTERVALS WITHIN A FRAME

BACKGROUND OF THE INVENTION

1. Field of the Invention

The present invention relates generally to a speech signal compression method. More particularly, it relates to a method for compressing a speech signal by using similarity of the $F_1/F_0$ ratios in pitch intervals within a frame.

2. Description of the Prior Art

A main feature of speech coding methods for the transfer of a speech signal is to process the speech signal taking into consideration data transmission and compression rates for the transfer of the speech information, data transmission and compression rates for the transfer of the speech signal, the quality of synthetic speech, and the processing speed. In particular, speech compression methods based on linear predictive modeling occupies most studies.

In such methods, an input speech is passed through a low pass filter and analog/digital (A/D)-converted by an A/D converter. A linear predictive coding (LPC) analysis is performed with respect to the resultant digital signal to extract a pitch therefrom if it corresponds to voiced speech. FIG. 1 shows the construction of a speech coder (vocoder) based on the linear predictive model. Parameters such as the extracted LP coefficient, pitch, and energy are coded by a coder and transmitted through a communication channel or stored in memory for synthesis. Then, the transmitted or stored parameters are decoded by a decoder and synthesized by a synthesis filter.

The pitch is generally a derived signal based on a predictive error signal correlation, speech signal low-frequency analysis correlation, average magnitude difference function (AMDF), or cepstrum. However, the LPC analysis is inappropriate in such a case as a nasal speech where zeros, as well as poles, are needed in the transfer function, because it uses an all-pole model. Further, the LPC analysis cannot satisfy a variety of voice variations in that a speech source is dualized into a pulse train or a white random Gaussian sequence. Moreover, it is difficult to make a distinction between voiced and unvoiced speech and to accurately detect the pitch.

SUMMARY OF THE INVENTION

Therefore, the present invention has been made in view of the above problems, and it is an object of the present invention to provide a pitch synchronization coding method that removes the redundancy of a speech signal using a fundamental frequency/first formant frequency ($F_1/F_0$) ratio, not a linear predictive model. Here, the fundamental frequency is a basic frequency indicative of the speaker's individuality and emotion, and the first formant frequency is a resonance frequency of a vocal tract from the glottis to the end of the lips.

In accordance with the present invention, above stated and other objects can be accomplished using a method for compressing a speech signal according to the present invention that uses similarity of the $F_1/F_0$ ratios in pitch intervals within a frame. This method comprises the steps of: dividing the speech signal into frames, each being of a predetermined size; checking whether each of the divided frames corresponds to a voiced speech; obtaining an $F_1/F_0$ ratio of an initial pitch interval and of subsequent pitch intervals of each frame corresponding to voiced speech; determining if data in each of the subsequent pitch intervals can be regarded as identical to data in the initial pitch interval by calculating if the difference between the obtained $F_1/F_0$ ratio corresponding to the subsequent pitch interval and the obtained $F_1/F_0$ ratio of the initial pitch interval is smaller than a predetermined value; and compressing data in each of the subsequent pitch intervals if it can be regarded as identical to data in the initial pitch interval according the determining step above.

DETAILED DESCRIPTION OF THE PREFERRED EMBODIMENTS

Figure 1:
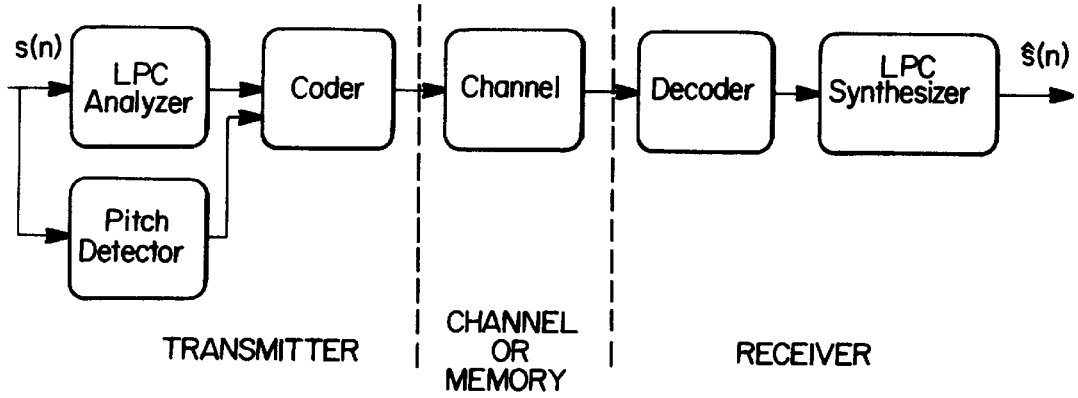
FIG. 1 is a block diagram illustrating the construction of an LPC vocoder system.
Figure 2A:
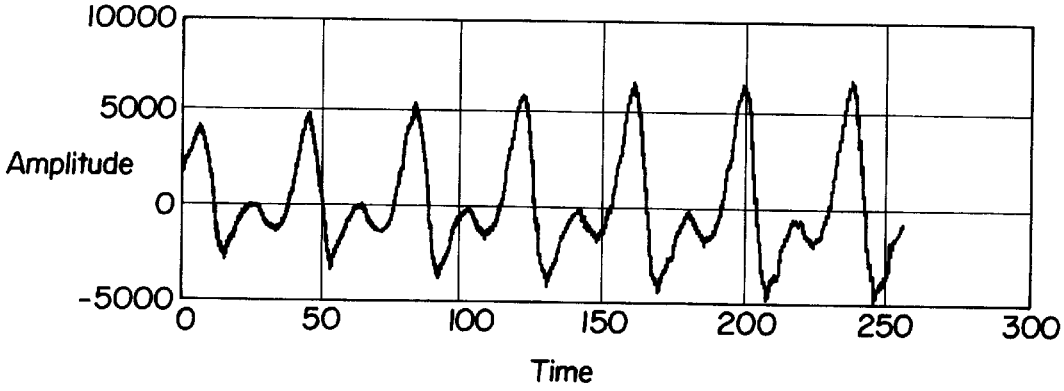
FIGS. 2*a* and 2*b* are waveform graphs showing a voiced speech.
Figure 2B:
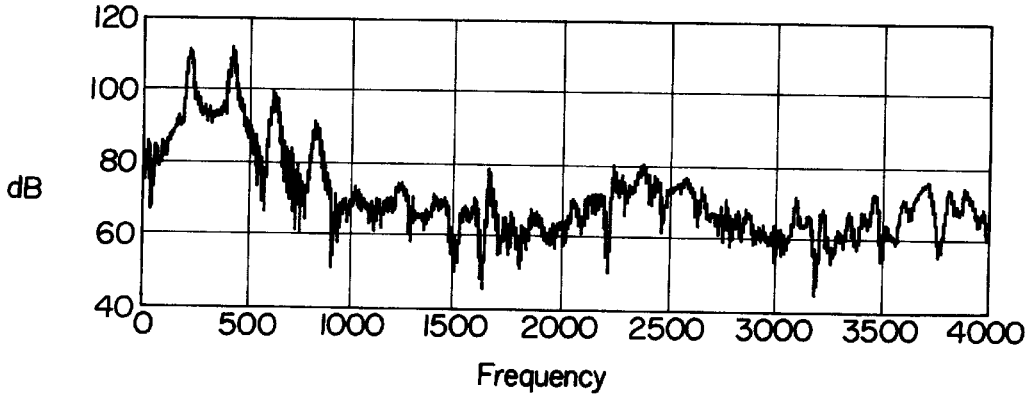

Speech signals are generally classified into voiced, unvoiced, and plosive speech according to their speech source. Unvoiced speech has no periodicity because an irregular noise generator is an excitation source, but is has higher average zero crossing rates than voiced speech because it includes resonance peaks around 3 kHz. Voiced speech is attended with resonance because it is produced when air ascending from the lung is discharged through the glottis. Due to the resonance of the vocal tract, voiced speech becomes a signal which has high energy and semi-periodic form as shown in FIG. 2*a*. Seeing voiced speech at a frequency domain, the fundamental frequency $F_0$ of the speech signal appears minutely at the resonance peaks on the vocal tract as shown in FIG. 2*b*. The frequencies corresponding to the resonance peaks on the vocal tract are called formants, and the lowest one thereof is referred to as the first formant $F_1$.

The first formant $F_1$ of voiced speech has energy higher by about 10 dB than other formants. For this reason, expressing the voiced speech signal at a time domain, the effect of the first formant $F_1$ mainly appears, and a reciprocal of a zero crossing interval (ZCI) in one pitch interval is approximately the same as 2 $F_1$. Also, attenuation vibration occurs in one pitch interval in the time domain since the formants have individual bandwidths.

An all pole model is preferred because the glottis characteristic g(n), or a semi-periodic pulse emitted from the lungs, is finite in length. More preferably, a bipole model may be used with respect to G(z)=z[g(n)]. (Where G is the Z-transform of the g(n) and z is the Z transform function. The radiation effect can be expressed as $R(z)=R_o(1-z^{-1})$, so that it operates as a high pass filter to emphasize the main resonance effect of the vocal tract. As a result, the voiced speech signal $s_v(n)$ can be expressed by convoluting the vocal tract and glottis characteristics in the time domain according to (1):

$$s_v(n)=h(n)*g(n) \tag{1}$$

At the frequency domain, the fundamental frequency of the speech signal is present within the range of 40 to 400 Hz, and the first formant frequency is known to be present within the range of 200 to 800 Hz. Hence, the $F_1/F_0$ ratio of the voiced speech signal is within the range of 1–20. At the time domain, the voiced speech signal can be limited to an interval where the number $F_0^{-1}$ of samples per period of the fundamental frequency is present within the range of 20 to 200 and the number $F_1^{-1}$ of samples per period of the first formant frequency is present within the range of 10 to 32.

Figure 3:
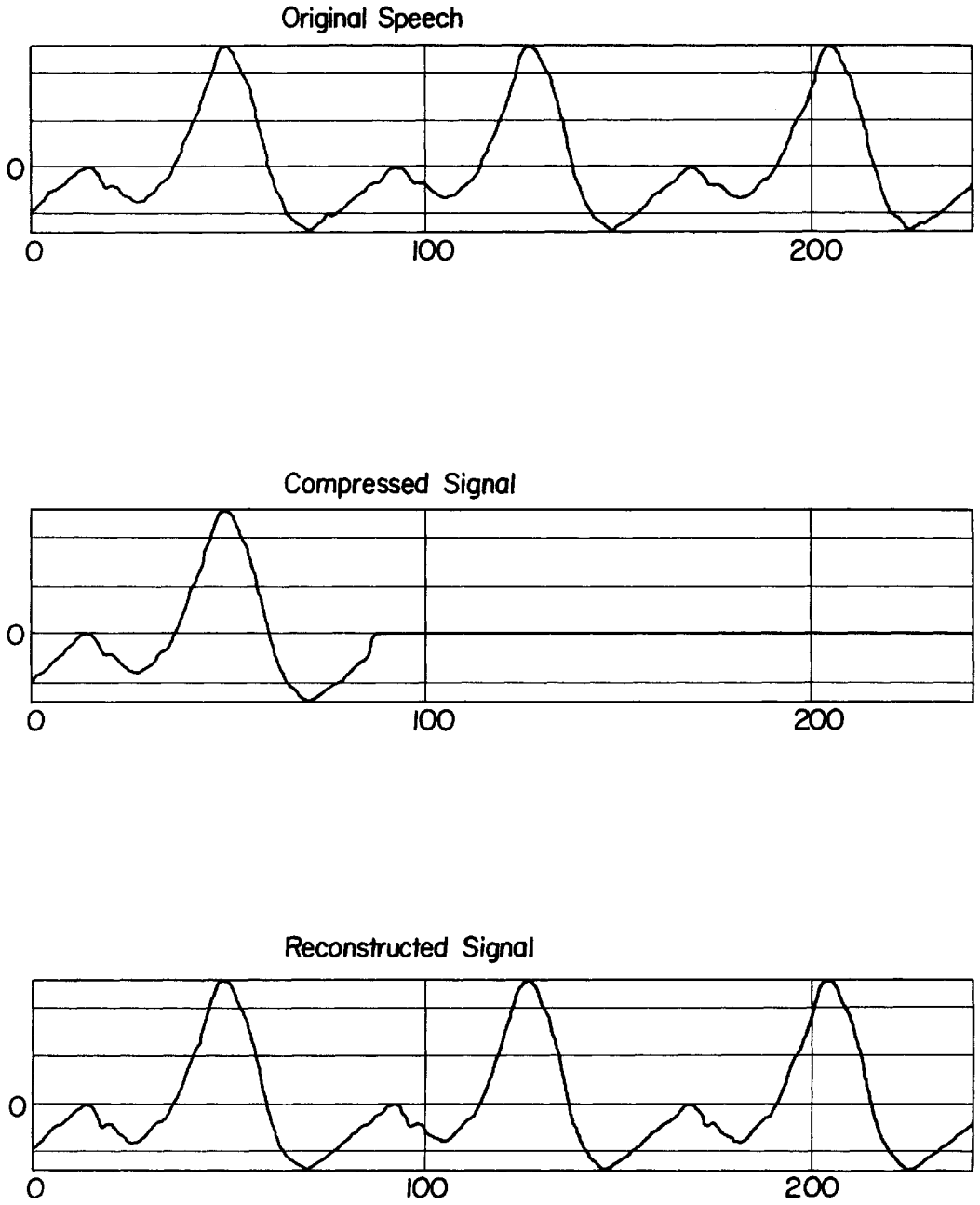
FIG. 3 is a waveform graph illustrating an example of voice signal compression using an $F_1/F_0$ ratio.

FIG. 3 shows the original speech signal, and speech signals compressed and reconstructed using the $F_1/F_0$ ratio.

Figure 4A:
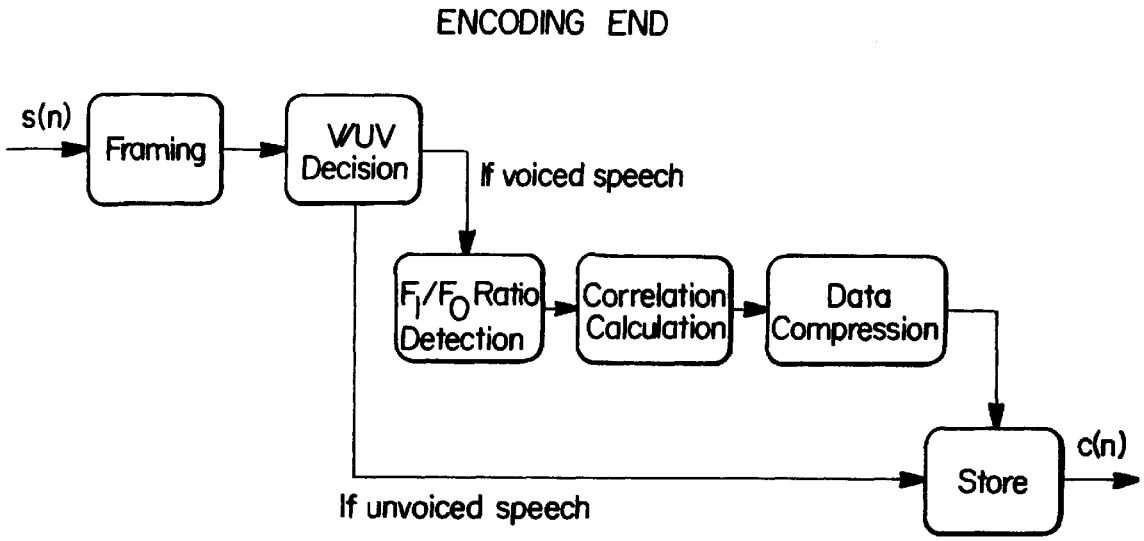
FIGS. 4*a* and 4*b* are flowcharts illustrating a speech signal compression method of the present invention.
Figure 4B:
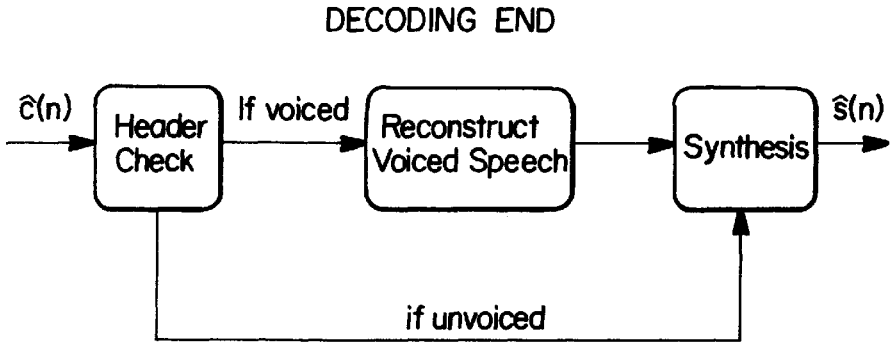

FIGS. 4*a* and 4*b* are flowcharts illustrating a speech signal compression method of the present invention. First, at the coding step, an input speech signal is divided into frames. For example, each frame can be 30 ms, although any other convenient frame size may be chosen. Each frame is then sorted based on whether it contains voiced or unvoiced speech. In a voiced speech frame, an initial pitch interval is set as representative, and the $F_1/F_0$ ratio of each pitch interval is measured. Then, the correlation between the $F_1/F_0$ ratio of the representative pitch interval and that of each pitch interval is calculated and a determination made as to whether data compression is to be performed by comparing the $F_1/F_0$ ratio of each pitch interval in the voiced speech frame with that of the representative pitch interval as follows $$R_r - R_t = D \tag{3}$$

where, $R_r$ is the $F_1/F_0$ ratio of the representative pitch interval and $R_t$ is the $F_1/F_0$ ratio of the target pitch interval being compared.

In the above expression, if D=0 then data compression for the target pitch interval is performed using any of a number of known algorithms that essentially involve the deletion (by replacement with a marker, for example) of any pitch interval with the same $F_1/F_0$ ratio as that of the representative pitch interval. Alternatively, the data compression may also be performed when D is less than or equal to a predetermined value, or less than a predetermined value, rather than when it is 0. Preferably, the compressible value of D may be adjusted appropriately according to applied systems.

For unvoiced speech frames, the data is not compressed or it is compressed using a less robust algorithm as desired. For example, for some applications that are time critical, such as for cellular phone conversations it may be desirable to store the frame as is or using minimal compression. For other applications, such as remote messaging or internet connected non-real time voice transmissions, slower maximum compression algorithms may be used.

In one such preferred data compression process, interval and amplitude differences between the representative pitch and compressed target pitches (that is the deleted target pitch intervals) are calculated and then inserted into a header of the corresponding frame in a 2 bit and together with PCM quantization information and the number and positions of deleted target pitch intervals, for transmission of storage.

At the decoding step, the header of the frame is first checked to determine whether the frame corresponds to a voiced or unvoiced speech. If the frame corresponds to unvoiced speech, it is directly reconstructed. However, in the case where the frame corresponds to voiced speech, the deleted pitch intervals of the frame are reconstructed according to the representative pitch interval thereof.

As is apparent from the above description, the present invention can remove the redundancy of the speech signal by using similarity of the $F_1/F_0$ ratios in pitch intervals within a frame and thereby overcome the problems with linear predictive modeling that has mainly been used in the existing voice compression methods. The following table 1 shows mean opinion score (MOS) values when the voice compression/reconstruction operations are performed according to the preferred method of the present invention.

| VOICE SAMPLE | AVERAGE COMPRESSION RATE | MOS Score |
|---|---|---|
| VOICE 1 | 60.3% | 4.10 |
| VOICE 2 | 62.2% | 4.04 |
| VOICE 3 | 64.3% | 4.08 |
| VOICE 4 | 61.4% | 4.10 |
| VOICE 5 | 72.5% | 3.95 |
| AVERAGE | 64.14% | 4.05 |

In the case where the MOS value exceeds 4.0, the average compression rate of 64.14% can be obtained with no feeling of deterioration in subjective speech quality.

Therefore, the present invention can significantly reduce the calculation time with no deterioration in speech quality, so that it can be applied to mobile communication and other speech compression application fields to lengthen battery life and realize the real-time process.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method for compressing a speech signal by using similarity of $F_1/F_0$ ratios in pitch intervals within a frame comprising the steps of:

dividing said speech signal into frames, each being of a predetermined size;

checking whether each of the divided frames corresponds to a voiced speech;

obtaining an $F_1/F_0$ ratio of an initial pitch interval and of subsequent pitch intervals of each frame corresponding to voiced speech;

determining if data in each of said subsequent pitch intervals can be regarded as identical to data in said initial pitch interval by calculating if the differences between the obtained $F_1/F_0$ ratio corresponding to said subsequent pitch interval and the obtained $F_1/F_0$ ratio of said initial pitch interval is smaller than a predetermined value;

compressing data in each of said subsequent pitch intervals if it can be regarded as identical to data in said initial pitch interval according to determining step above.

2. The method for compressing a speech signal using an analogy between $F_1/F_0$ ratios in pitch intervals, as set forth in claim 1, wherein said predetermined value is 0.

3. The method for compressing a speech signal using an analogy between $F_1/F_0$ ratios in pitch intervals, as set forth in claim 1, wherein said predetermined value is less than or equal to 0.

4. The method for compressing a speech signal using an analogy between $F_1/F_0$ ratios in pitch intervals, as set forth in claim 1, wherein said predetermined value is less than 0.

* * * * *